US007370611B1

(12) United States Patent
White et al.

(10) Patent No.: US 7,370,611 B1
(45) Date of Patent: May 13, 2008

(54) APPARATUS AND METHOD FOR CONTROLLING THE OPERATION OF A COOLING SYSTEM FOR A MARINE PROPULSION DEVICE

(75) Inventors: Brian R. White, Stillwater, OK (US); Dennis M. McClurg, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/606,803

(22) Filed: Nov. 30, 2006

(51) Int. Cl.
*F01P 7/14* (2006.01)

(52) U.S. Cl. ..... 123/41.01; 60/323; 440/88 J; 123/196 AB

(58) Field of Classification Search ..... 123/41.08, 123/41.09, 41.31, 41.33, 196 AB, 41.01, 123/195 P; 60/323; 440/88 J
See application file for complete search history.

(56) References Cited

U.S. PATENT DOCUMENTS 4,082,068 A 4/1978 Hale
4,768,492 A 9/1988 Widmer et al.
5,170,753 A 12/1992 Sato
5,383,803 A 1/1995 Pilgrim
5,503,118 A 4/1996 Hollis
5,563,585 A 10/1996 MacDonald
5,660,536 A 8/1997 Karls et al.
6,390,031 B1 5/2002 Suzuki et al.
6,598,566 B2 7/2003 Yasuda et al.
6,712,028 B1 3/2004 Robbins et al.
7,082,903 B2 8/2006 Hutchins
7,258,083 B2 * 8/2007 Lindsey ..... 123/41.08

* cited by examiner

*Primary Examiner*—Stephen K. Cronin
*Assistant Examiner*—Hyder Ali
(74) *Attorney, Agent, or Firm*—William D. Lanyi

(57) ABSTRACT

A cooling system for a marine propulsion device provides a bypass loop around a cooling pump that allows the flow of cooling water through certain components to be reduced or increased as a function of the temperature of those components while causing a full flow of cooling water to flow through other selected heat emitting devices. Using this configuration of components and bypass conduits, the operating condition of the cooling water pump can be continually monitored, including the condition of its flexible vanes. By observing the effective cooling capacity of the system under conditions with the bypass valve open and closed, the effectiveness of the cooling water pump can be assessed and a suggestion of maintenance can be provided.

17 Claims, 4 Drawing Sheets

APPARATUS AND METHOD FOR CONTROLLING THE OPERATION OF A COOLING SYSTEM FOR A MARINE PROPULSION DEVICE

BACKGROUND OF THE INVENTION

The present invention is generally related to the invention described in U.S. patent application Ser. No. 11/606,471, filed on Nov. 30, 2006.

FIELD OF THE INVENTION

The present invention is generally related to a cooling system for a marine propulsion device and, more particularly, to a configuration and method of operation of a bypass conduit associated with a cooling water pump which is particularly configured to provide a first level of cooling for certain components within a recirculation cooling loop of the pump and a second level of cooling for other components outside the recirculation cooling loop.

DESCRIPTION OF THE RELATED ART

Those skilled in the art of marine propulsion devices are familiar with many different structures and methods used to circulate cooling water or other liquid coolants in thermal communication with heat emitting devices for the purpose of removing heat from the marine propulsion device. As an example, internal combustion engines are normally provided with cooling jackets through which coolant can flow in thermal communication with heat producing sections of the engine. Some marine cooling systems are open loop systems in which water is drawn from a body of water, such as a lake or ocean, and that water is circulated throughout all of the cooling conduits of the marine propulsion system. Alternatively, the marine propulsion device can be provided with a closed or semi-closed loop system in which a coolant is circulated through certain components, such as the engine, and through a heat exchanger wherein the coolant is cooled by thermal communication with a flow of water drawn from a lake or ocean.

U.S. Pat. No. 4,082,068, which issued to Hale on Apr. 4, 1978, discloses a V-engine cooling system particularly for outboard motors and the like. A cooling passageway extends upwardly through the central core and is discharged into a chamber in an exhaust manifold cover between the cylinder banks of the V-engine. The water passes through the cover and to the lateral side edges which have inlets to cooling chambers about the opposite cylinder banks which are continuous and discharge at the uppermost end. The cylinder heads have a cooling chamber with top inlets aligned with the cylinder discharge.

U.S. Pat. No. 4,768,492, which issued to Widmer et al. on Sep. 6, 1988, discloses a marine propulsion system with a fuel line cooler. The cooler is provided for a marine propulsion system having a water cooled internal combustion engine in a heat retentive compartment. The fuel line cooler has an inlet in communication with the source of cooling water for the engine, and has an outlet for discharging water. The fuel line cooler is cooled by sea water during running of the engine. Upon turn off of the engine, the cooled water in the fuel line cooler is in heat transfer relation with fuel and prevents vaporization and/or spewing of the fuel.

U.S. Pat. No. 5,170,753, which issued to Sato on Dec. 15, 1992, describes a sea water cooling apparatus for a marine diesel engine. The engine has a supercharger and is provided with a thermostat to recycle at least part of the cooling water through a first bypass line to the inlet of the sea water pump until the warming up operation has been accomplished. A second bypass line containing a valve is provided between the inlet of the thermostat and the water outlet to the sea, in order to achieve a satisfactory large output if a rapid accelerating operation is performed after the warming up operation has been performed or in case of an operation under a large load. The valve in the second bypass line can be operated responsive to the sea water pump discharge pressure or the discharge pressure of the supercharger and/or the engine revolution speed. A fuel cooler can be included in the outlet conduit of the sea water pump, with the fuel cooler, the engine and a fuel tank being connected to one another by fuel conduits.

U.S. Pat. No. 5,383,803, which issued to Pilgrim on Jan. 24, 1995, describes an outboard motor cooling system. A two or four cycle outboard motor is equipped with a closed circuit cooling system having a coolant pump, a heat exchanger, an expansion tank, a series of coolant passages in the motor and some external piping to complete the circuit. In one embodiment of the invention, a conventional outboard motor is modified to include the closed circuit coolant system with the conventional water pump being converted to the coolant pump. In this modified embodiment, the thermostat seals have to be modified, the pump has to be sealed, and several bypass holes have to be plugged in the engine to isolate the flow of coolant.

U.S. Pat. No. 5,503,118, which issued to Hollis on Apr. 2, 1996, describes an integral water pump/engine block bypass cooling system. A temperature control system in an internal combustion engine includes a water pump which controls the channeling of temperature control fluid between the engine block and the cylinder head. The water pump includes at least one flow channel designed to direct the flow of temperature control fluid into the engine block. There is at least one flow restrictor valve located within the water pump which is adapted to control the flow of temperature control fluid along the flow channel. The flow restrictor valve is actuatable between a first position which permits flow of temperature control fluid along the flow channel and a second position which restricts or inhibits flow along the flow channel.

U.S. Pat. No. 5,563,585, which issued to MacDonald on Oct. 8, 1996, describes a water pump monitor. A transparent housing for installation in a marine raw water line is provided. The housing has an inlet chamber including a perforated plate disposed athwart the housing and comprising the downstream wall of the chamber. The plate permits water flow while acting to trap unwanted materials in the water stream. The transparent housing provides means for visual monitoring of the plate and of the interior of the inlet chamber.

U.S. Pat. No. 5,660,536, which issued to Karls et al. on Aug. 26, 1997, discloses a high capacity simplified sea water pump. The pump includes a housing having a generally cylindrical pumping chamber defined by a generally cylindrical side wall extending axially between opposite endwalls. A multi-vaned rotary impeller in the chamber is driven by an impeller shaft extending axially into the chamber through one of the endwalls. An intake port at the other endwall has a first branch providing radial flow into the chamber, and a second branch providing axial flow into the chamber. A discharge port has a first branch receiving radial flow out of the chamber and a second branch receiving axial flow out of the chamber. The housing is an integrally molded one piece cup-shaped unit including the cylindrical sidewall integral with an end cap providing a flat inner wall wear surface providing the noted endwall engaging an axial end of the impeller in sealing sliding relation.

U.S. Pat. No. 6,390,031, which issued to Suzuki et al. on May 21, 2002, describes a cooling apparatus for liquid cooled internal combustion engines. A flow rate ratio of a radiator flow rate to a bypass flow rate is determined from pump water temperature, bypass water temperature and a radiator water temperature. The relation between the flow rate ratio and a valve opening degree of a flow control valve is predetermined as a map. The valve opening degree is determined from the flow rate ratio and the map. Accordingly, the cooling water temperature at an inlet of a pump is accurately controlled without detecting the flow rate of the cooling water.

U.S. Pat. No. 6,598,566, which issued to Yasuda et al. on Jul. 29, 2003, describes a water-cooled outboard marine engine. A heat transfer portion is provided in an exit passage located between an outer end of a cylinder water jacket and a cooling water outlet passage at a position upstream of the thermostat valve. Thus, when the thermostat valve has opened and the cooling water expelled from the water jacket via the thermostat valve has been replaced by freshly introduced cooling water, the heat transfer portion having a certain heat capacity warms the freshly introduced cooling water so that the rapid change in the cooling water temperature at the thermostat valve and the resulting hunting of the thermostat valve can be avoided.

U.S. Pat. No. 6,712,028, which issued to Robbins et al. on Mar. 30, 2004, describes an engine cooling system with water pump recirculation bypass control. The system bypass is used to reduce parasitic losses in an internal combustion engine. The system bypass has a diverter valve actuated by a control module to selectively control the amount of coolant flow through the engine without regard to the speed of the water pump. As less coolant is needed to control the engine, the diverter valve directs more coolant through the bypass to be recirculated to the water pump. The energy absorbed by the water pump is reduced by the reduced coolant flow, which increases the efficiency of the system and reduces engine parasitic losses.

U.S. Pat. No. 7,082,903, which issued to Hutchins on Aug. 1, 2006, describes a temperature responsive flow control valve for engine cooling systems. An engine cooling system has a primary cooling circuit with a pump to circulate liquid coolant through an engine, the coolant being returned to the pump via a radiator and a bypass arranged in parallel. A temperature responsive control valve controls flow as between the radiator and the bypass. The valve housing defines a hot inlet connected to the bypass, a cold inlet connected to the radiator, and a valve chamber. The valve further includes a first valve member in the valve chamber movable between two limits to control the flow of coolant from the hot inlet to the outlet, a second valve member in the valve chamber movable between two limits to control coolant flow from the cold inlet to the outlet, and a temperature responsive actuator to move the first and second valve members.

The patents described above are hereby expressly incorporated by reference in the description of the present invention.

It would be significantly beneficial if a cooling system could be provided in which the flow of cooling water, drawn from a lake or body of water, could be more accurately and advantageously controlled to prevent condensation occurring within certain components (e.g. exhaust conduits) while assuring that adequate cooling occurs in other components.

SUMMARY OF THE INVENTION

A cooling system for a marine propulsion device, made in accordance with a preferred embodiment of the present invention, comprises a cooling passage disposed in thermal communication with a heat emitting component, a pump having an outlet port connected in fluid communication with an outlet conduit and an inlet port connected in fluid communication with an inlet conduit, a bypass conduit connected in fluid communication between the outlet conduit and the inlet conduit, a valve connected in fluid communication with the bypass conduit, and a controller connected in signal communication with the valve. The inlet conduit is configured to conduct water to the pump from a body of water in which the marine propulsion device is operated. The outlet conduit is connected in fluid communication with the cooling passage. The controller is configured to control the valve as a function of a sensed operating parameter of the marine propulsion device. A fuel cooler is connected in fluid communication with the outlet conduit between the pump and valve in a preferred embodiment of the present invention and a steering fluid cooler is connected in fluid communication with the outlet conduit between the pump and the valve. An oil cooler is connected in fluid communication with the outlet conduit. The bypass conduit is connected to the outlet conduit between the pump and the oil cooler. An exhaust conduit is connected in fluid communication with the outlet conduit. The bypass conduit is connected to the outlet conduit between the pump and the exhaust conduit. One or more temperature sensors are connected in signal communication with the controller and disposed in thermal communication with various components, such as the exhaust conduit. The sensed operating parameter described above can be a sensed temperature of the exhaust conduit. The heat emitting component is a heat exchanger in a preferred embodiment of the present invention. An engine can be provided in which a cooling channel is configured to conduct a coolant, such as ethylene glycol, in thermal communication with heat producing portions of the engine and in thermal communication with a water channel of the heat exchanger. The water channel of the heat exchanger is disposed in fluid communication with the outlet conduit. In a preferred embodiment of the present invention, the system further comprises a temperature sensor connected in signal communication with a controller and disposed in thermal communication with the coolant. The sensed operating parameter of the marine propulsion device can be a sensed temperature of the coolant.

A method for controlling the cooling system for a marine propulsion device, in a preferred embodiment of the present invention, comprises the steps of disposing the cooling passage in thermal communication with a heat emitting component, providing an inlet conduit and an outlet conduit, providing a pump having an outlet port connected in fluid communication with the outlet conduit and an inlet port connected in fluid communication with the inlet conduit, connecting a bypass conduit in fluid communication between the outlet conduit and the inlet conduit, connecting a valve in fluid communication with the bypass conduit, measuring a representative temperature of the cooling system, determining a preferred state of the valve as a function of the representative temperature, and causing the valve to be in that preferred state. The measuring step can comprise the step of measuring a first temperature at a first preselected location of the marine propulsion device and measuring a second temperature at a second preselected location of the marine propulsion device. The first preselected location can be an exhaust conduit and the second preselected location can be a position within a flow of conduit, such as within a closed cooling system of the engine. The representative temperature can be a function of the higher of the first and second measured temperatures. The heat emitting component can be a heat exchanger having a coolant circuit disposed in thermal communication with the cooling passage and the measuring step can comprise the step of measuring a temperature of coolant flowing through the coolant circuit. The method of the present invention can further comprise connecting a fuel cooler in fluid communication with the outlet conduit between the pump and valve, connecting a steering fluid cooler in fluid communication with the outlet conduit between the pump and the valve, connecting an oil cooler in fluid communication with the outlet conduit with the bypass conduit being connected to the outlet conduit between the pump and the oil cooler and connecting an exhaust conduit in fluid communication with the outlet conduit, with a bypass conduit being connected to the outlet conduit between the pump and the exhaust conduit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
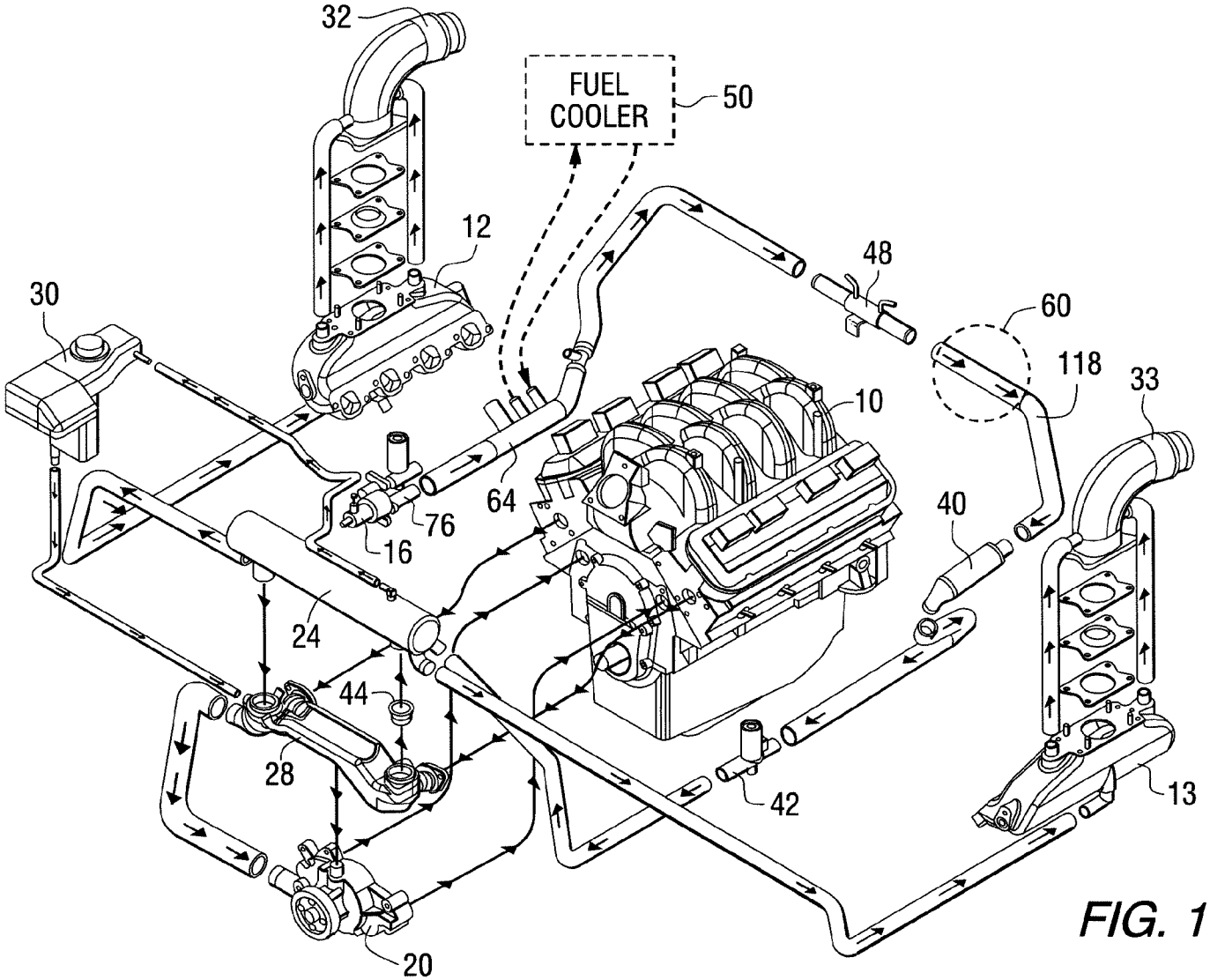
FIG. 1 is an isometric exploded view of a cooling system for a marine propulsion device.

Throughout the description of the preferred embodiment of the present invention, like components will be identified by like reference numerals.

FIG. 1 is an exploded isometric view of a cooling system for a marine propulsion device. The components illustrated in FIG. 1 comprise an internal combustion engine 10, exhaust manifolds 12 and 13, a cooling water pump 16, a recirculation pump 20, a heat exchanger 24, a coolant crossover conduit 28, a coolant reservoir 30, exhaust elbows 32 and 33, an oil cooler 40, an air actuator 42, a thermostat 44, a transmission cooler 48, and a fuel cooler 50. In addition, FIG. 1 shows various gaskets disposed between the exhaust manifolds, 12 and 13, and the exhaust elbows 32 and 33. The conduits illustrated between the various components in FIG. 1 are also provided with arrows showing the direction of flow of coolant, such as ethylene glycol, and water which is drawn from the body of water in which the marine propulsion system is operated. The area identified by dashed circle 60 illustrates the position, or region, in which a portion of the present invention is located in a preferred embodiment of the present invention. Although not shown in FIG. 1, the components of the present invention provide advantageous fluid communication between the region 60 which is downstream from the transmission cooler 48 and the water pump 16 which is configured to draw water from the body of water in which the marine propulsion device is operated. Within the conduit identified by reference numeral 64, an orifice is provided which induces a flow of water, as represented by the dashed line arrows, to and from the fuel cooler 50.

Figure 2:
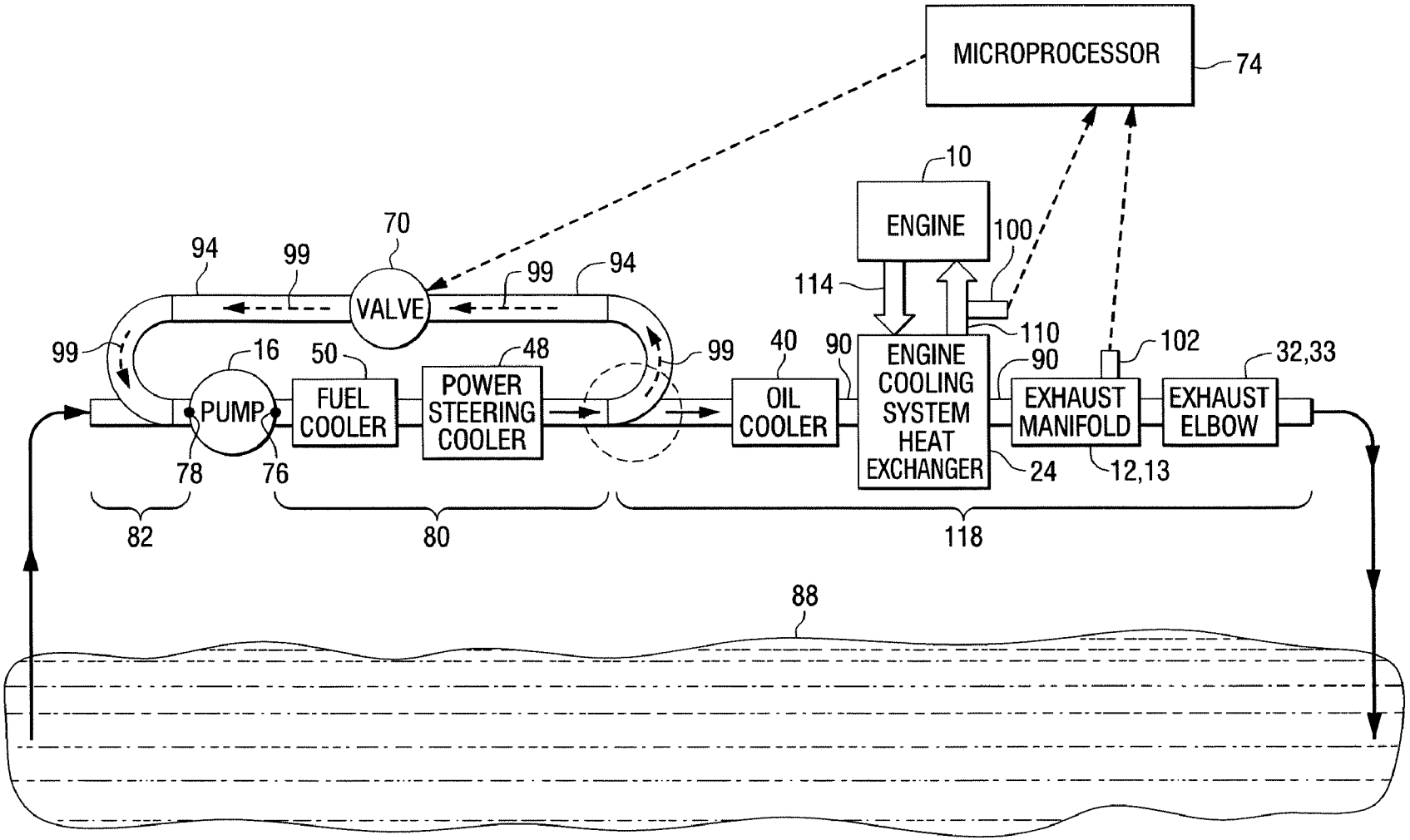
FIG. 2 is a schematic representation of a portion of the cooling system of a marine propulsion device.

FIG. 2 is a schematic representation of an adaptation of the cooling system shown in FIG. 1 in which a valve 70 and a microprocessor 74 are used to more effectively control the temperature of the various components illustrated in FIGS. 1 and 2.

In FIG. 2, a cooling passage 90 is disposed in thermal communication with a heat emitting component. In a particularly preferred embodiment of the present invention, the cooling passage is connected to the cooling water conduit contained within the internal structure of the engine cooling system heat exchanger 24. This heat exchanger 24, in a preferred embodiment, is the heat emitting component described above. It should be understood that other heat emitting components can be configure to receive cooling water from the pump 16. The cooling system further comprises the pump 16, described above, which has an outlet port 76 and an inlet port 78. The outlet port 76 is connected in fluid communication with an outlet conduit 80 and the inlet port 78 is connected in fluid communication with an inlet conduit 82. The inlet conduit 82 is configured to conduct water to the pump 16 from a body of water 88 in which the marine propulsion device is operated. The outlet conduit 80 is connected in fluid communication with cooling water passage 90 which extends through the heat exchanger 24. A bypass conduit 94 is connected in fluid communication between the outlet conduit 80 and the inlet conduit 82. A valve 70 is connected in fluid communication with the bypass conduit 94 and configured to affect the rate of flow of water, as represented by dashed line arrows 99 in FIG. 2, from the outlet conduit 80 to the inlet conduit 82. A controller 74 is connected in signal communication with the valve 70 and configured to control the valve as a function of a sensed operating parameter of the marine propulsion device.

In the preferred embodiment of the present invention, it further comprises a fuel cooler 50 connected in fluid communication with the outlet conduit 80 between the pump 16 and the valve 70 or, alternatively stated, between the pump 16 and the bypass conduit 94. The preferred embodiment of the present invention further comprises a steering fluid cooler 48 connected in fluid communication with the outlet conduit 80 between the pump 16 and the valve 70 or, alternatively stated, between the pump 16 and the bypass conduit 94.

In a particularly preferred embodiment of the present invention, an oil cooler 40 is connected in fluid communication with the outlet conduit 80 and the bypass conduit 94 is connected to the outlet conduit 80 between the pump 16 and the oil cooler 40. Similarly, a preferred embodiment of the present invention further comprises an exhaust conduit, such as the exhaust manifolds 12 and 13 and the exhaust elbows 32 and 33, connected in fluid communication with the outlet conduit 80. The bypass conduit 94 is connected to the outlet conduit 80 between the pump 16 and the exhaust conduit which, as described above, comprises the exhaust manifolds 12 and 13 and the exhaust elbows 32 and 33 in a preferred embodiment of the present invention.

In a preferred embodiment of the present invention, temperature sensors 100 and 102 are connected in signal communication with the controller 74 and disposed in thermal communication with the closed cooling circuit of the engine and the exhaust manifold, respectively. Arrows 110 and 114 represent the coolant flow between the cooling system of the engine 10 and the heat exchanger 24. This coolant is typically an ethylene glycol mixture and the cooling system represented by arrows 110 and 114 is a closed system. Heat is removed from the coolant in the closed system by cooling water flowing through the heat exchanger 24. The conduit identified by reference numeral 118 in FIG. 2 provides cooling water drawn from the body of water 88 to remove heat from the oil cooler 40, the heat exchanger 24, the exhaust manifolds 12 and 13, and the exhaust elbows 32 and 33. As represented in FIG. 2, the water is then returned to the body of water 88 from which it was drawn by the pump 16.

With continued reference to FIGS. 1 and 2, it can be seen that an important advantage of the present invention is that it selectively provides a full flow of cooling water to certain heat emitting components, such as the fuel cooler 50 and power steering cooler 48, under all circumstances and regardless of the state of valve 70. It also provides a selectively reduced flow of cooling water to the oil cooler 40, the heat exchanger 24, the exhaust manifolds 12 and 13, and the exhaust elbows 32 and 33, when the valve 70 is opened. When the valve 70 is closed, all of the heat emitting components which are connected in thermal communication with the conduit 118 receive a greater flow of cooling water from the pump 16. In one particular embodiment of the present invention, the bypass conduit 94 and the conduit 118 are sized so that a pump 16 providing a flow of water of six gallons per minute will recirculate approximately 5.5 gallons per minute through the bypass conduit 94 when the valve 70 is open. As a result, opening the valve 70 reduces the flow of cooling water through the oil cooler 40, heat exchanger 24, and exhaust components to approximately 0.5 gallons per minute. This allows those components to reach operating temperature more quickly and avoids the likelihood that condensation will occur within their individual cooling passages. In other words, components like the oil cooler 40 and exhaust components benefit from a lower flow of cooling water because condensation within their structures is reduced. The exhaust components, such as exhaust manifolds 12 and 13 and exhaust elbows 32 and 33, in particular, benefit significantly by operating at higher initial temperatures. Passing excessive cooling water through them when their temperatures have not reached operating levels can be deleterious because of the likely inducement of condensation within their structures. Other components, such as the fuel cooler 50 and power steering cooler 48 can always benefit from operating at lower temperatures. Therefore, the flow of cooling water through them is not significantly reduced when the valve 70 is opened to allow a bypass flow through the bypass conduit 94.

With continued reference to FIGS. 1 and 2, the flow of cooling water through the oil cooler 40, heat exchanger 24, and exhaust components is reduced to approximately 0.5 gallons per minute when they are operating at temperatures lower than a preselected lower threshold magnitude. When the representative temperature of these components increases to an upper threshold magnitude, the valve 70 is closed and all of the water pumped by the water pump 16 flows through them.

Temperature sensors, 100 and 102, are illustrated to show exemplary locations where representative temperatures can be measured and used by the microprocessor 74 to determine how the valve 70 will be controlled.

With continued reference to FIGS. 1 and 2, it can be seen that a cooling system for a marine propulsion device, made in accordance with a preferred embodiment of the present invention, comprises a cooling passage (e.g. a water passage contained within the heat exchanger 24) in thermal communication with a heat emitting component (e.g. a coolant conduit within the heat exchanger 24), a pump 16 having an outlet port 76 connected in fluid communication with an outlet conduit 80 and an inlet port 78 connected in fluid communication with an inlet conduit 82, a bypass conduit 94 connected in fluid communication between the outlet conduit 80 and the inlet conduit 82, a valve 70 connected in fluid communication with the bypass conduit 94 and configured to affect the rate of flow of water from the outlet conduit 80 to the inlet conduit 82, and a controller 74 connected in signal communication with the valve 70 and configured to control the valve as a function of a sensed operating parameter, such as temperatures measured by sensors 100 and 102, of the marine propulsion device. The inlet conduit 82 is configured to conduct water to the pump 16 from a body of water 88 in which the marine propulsion device is operated. The outlet conduit 80 is connected in fluid communication with the cooling passage that conducts water through the heat exchanger 24.

With continued reference to FIGS. 1 and 2, a fuel cooler 50 is connected in fluid communication with the outlet conduit 80 between the pump 16 and the valve 70, a steering fluid cooler 48 is connected in fluid communication with the outlet conduit 80 between the pump 16 and the valve 70, an oil cooler 40 is connected in fluid communication with the outlet conduit 80 and the bypass conduit 94 is connected to the outlet conduit 80 between the pump 16 and the oil cooler 40, and an exhaust conduit (e.g. the exhaust manifolds 12 and 13 and exhaust elbows 32 and 33) is connected in fluid communication with the outlet conduit 80 with the bypass conduit 94 being connected to the outlet conduit 80 between the pump 16 and the exhaust conduit. Temperature sensors, 100 and 102, are connected in signal communication with the controller 74 and disposed in thermal communication with components, such as the exhaust conduit and a coolant conduit between the heat exchanger 24 and engine 10.

The pump 16 described above typically comprises a plurality of flexible blades that rotate to induce the flow of water from the body of water 88 and into the cooling system of the marine propulsion device. The flexible blades can wear as a result of continued use. When the blades wear, their overall efficiency is decreased. This reduction in pumping efficiency may not be immediately noticed. Instead the flow of water pumped by an aging pump may gradually decrease over several years of use. Eventually, the flow rate of cooling water pumped by the worn blades will be reduced to a degree that causes an overheating condition of the marine propulsion device and may cause damage to certain heat emitting components.

The configuration of a preferred embodiment of the present invention, as described above in conjunction with FIGS. 1 and 2, allows the operating condition of the pump 16 to be monitored so that an alarm can be generated before a catastrophic failure occurs. In other words, when the pumping efficiency of the flexible blades of the pump 16 is reduced to a level that indicates a shortened life span of the pump, but while the pump is still operable to protect the heat emitting components of the marine propulsion device, the operator of the marine vessel can be alerted that maintenance is required. At that time, a new pump can be provided or the worn blades of the pump can be replaced. This method of monitoring the operating condition of the pump 16 is described in greater detail below.

A method for controlling a cooling system for a marine propulsion device, in a preferred embodiment of the present invention, comprises the steps of disposing a cooling passage in thermal communication with a heat emitting component (e.g. heat exchanger 24), providing an inlet conduit 82 and an outlet conduit 80, providing a pump having an outlet port 76 connected in fluid communication with the outlet conduit 80 and an inlet port 78 connected in fluid communication with the inlet conduit 82, connecting a bypass conduit 94 in fluid communication between the outlet conduit 80 and the inlet conduit 82, connecting a valve 70 in fluid communication with the bypass conduit 94, measuring a representative temperature of the cooling system, such as by temperature sensors 100 and 102, determining a preferred state (e.g. open or closed) of the valve 70 as a function of the representative temperature, and causing the valve 70 to be in the preferred state.

The preferred embodiment of the present invention will be described in terms of a valve 70 which is binary in nature. In other words, this exemplary valve is either open or closed, with no position between those extremes. However, it should be clearly understood that linear valves can also be used in conjunction with the present invention. A linear valve, in contrast to a binary-type valve, can be caused to select intermediate rates of flow between the fully open and fully closed positions.

In a preferred embodiment of the present invention, the determining step can comprise the steps of selecting a closed state for the valve 70 as the preferred state when the representative temperature is above a preselected upper threshold magnitude and, alternatively, selecting an open state for the valve 70 as the preferred state when the representative temperature is below a preselected lower threshold magnitude.

A preferred embodiment of the present invention can further comprise the step of monitoring the response of the representative temperature as a function of the state of the valve. In other words, by monitoring the change in temperature at temperature sensors 100 and 102, the microprocessor 74 can observe the rate of cooling affected at those locations when the valve 70 is closed and a full flow of cooling water from the pump 16 flows through the components associated with those measured temperatures. After the valve 70 is closed, the elapsed time for those temperatures or a representative temperature determined as a function of those temperatures to decline to a desired lower threshold can be indicative of the condition of the pump 16. In other words, if the blades of the pump are worn, a longer elapsed time will be required with the valve 70 closed to lower the temperature at the locations of the temperature sensors, 100 and 102. A new and unworn set of pump blades will more quickly lower that representative temperature.

A preferred embodiment of the present invention can therefore further comprise the step of assessing the operating condition of the pump 16 as a function of the response of the representative temperature. This monitoring of the change of the representative temperature can take several forms in alternative embodiments of the present invention. For example, it can comprise the step of monitoring the elapsed time for the representative temperature to achieve the lower threshold magnitude after the valve 70 is caused to change from an open state to a closed state. Alternatively, it can comprise the step of monitoring the elapsed time that the valve 70 is in the closed state before the representative temperature is generally equal to the lower threshold magnitude.

The measuring step in a preferred embodiment of the present invention comprises the steps of measuring a first temperature at a first preselected location (e.g. by temperature sensor 100) of the marine propulsion device and of measuring a second temperature at a second preselected location (e.g. by temperature 102) of the marine propulsion device. The first preselected location can be within the coolant flow of the closed loop between the heat exchanger 24 and the engine 10 and the second preselected location in a preferred embodiment of the present invention can be associated with the exhaust conduit. It should be understood that the particular location where the temperatures are sensed is not limiting to the present invention. In addition, the representative temperature can be derived as a function of the highest of the individual measured temperatures or through some alternative type of calculation relating to the measured temperatures. As described above, it should be understood that the heat emitting component can be a heat exchanger 24 having a cooling circuit disposed in thermal communication with the cooling passage and the measuring step can comprise the step of measuring a temperature of coolant flowing through the cooling circuit. As described above, the arrangement of components, in addition to the valve 70 and pump 16, can include the fuel cooler 50, the power steering cooler 48, the oil cooler 40, the heat exchanger 24, and the exhaust conduit components as illustrated in FIGS. 1 and 2, but alternative configurations are also possible within the scope of the present invention.

Figure 3:
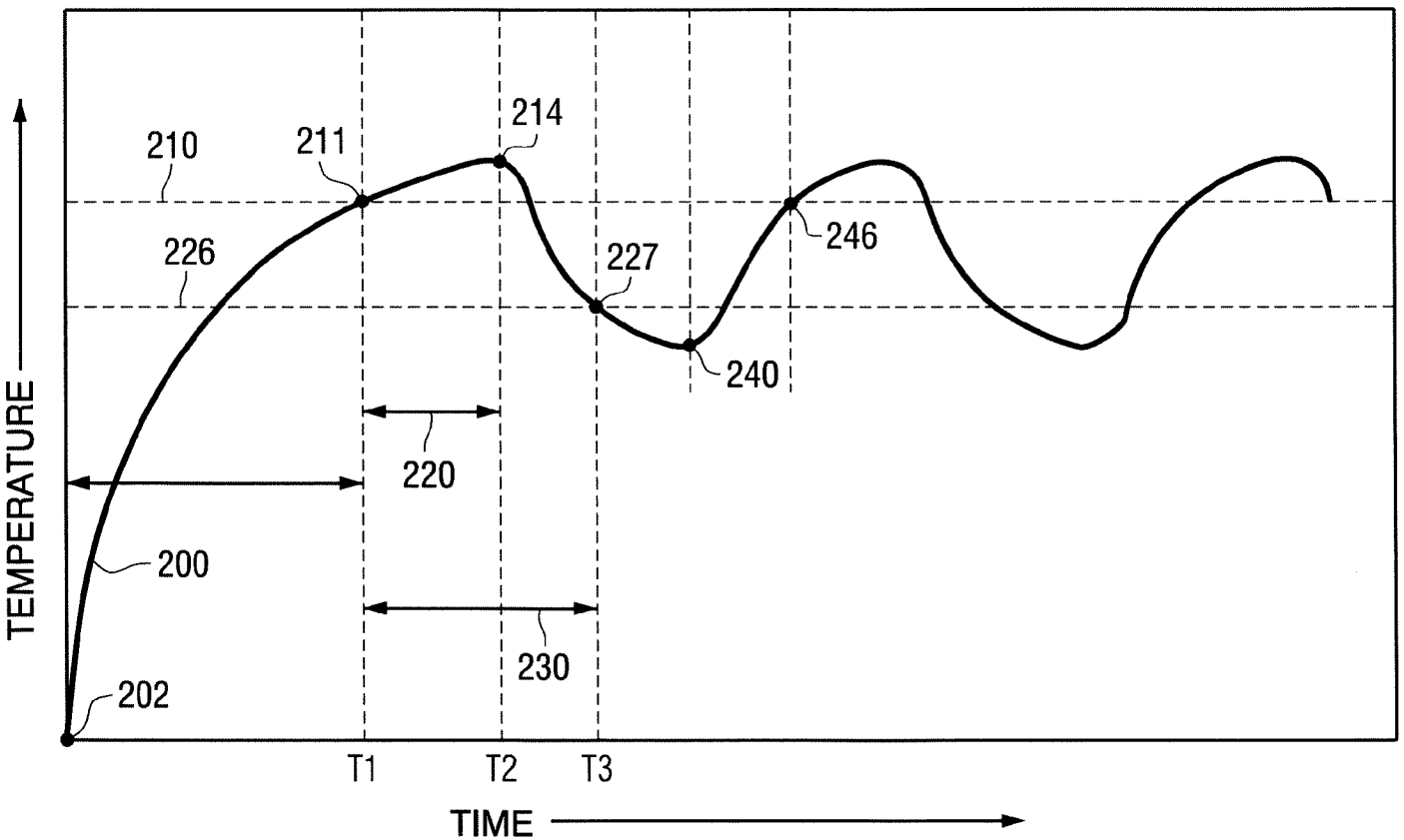
FIG. 3 is an exemplary and hypothetical graphical representation of the temperature profile resulting from opening and closing a valve of the cooling system.

FIG. 3 is an exemplary hypothetical time-based graph showing changes in a representative temperature which is determined as a function of the temperatures measured by sensors 100 and 102 illustrated in FIG. 2. It should be understood that the curve in FIG. 3 is hypothetical, but it illustrates the basic concepts of a preferred embodiment of the present invention.

With continued reference to FIG. 3, the curve 200 represents the representative temperature determined by the microprocessor 74 from the information provided by sensors 100 and 102. From an initial startup, at point 202, the temperature rises until it reaches an upper threshold magnitude 210 as represented by point 211. At that point, which is identified as time T1, the state of the valve 70 is changed from open to closed. This causes all of the water pumped by the pump 16 to flow through the components at which the measured temperatures are taken. Due to the time it takes for the additional water to reach the heat emitting components, a slight overshoot occurs and the temperature reaches the magnitude illustrated at point 214 before it begins to decrease as a result of the additional water flowing through the heat emitting components. The time between these points is represented by arrow 220. The additional flow of cooling water causes the representative temperature to decrease until it eventually reaches the lower threshold magnitude 226 at point 227. That elapsed time, between points 211 and 227, can be stored by the microprocessor 74 and compared to previously stored magnitudes of similar elapsed times between the valve 70 being closed and the temperature 200 reaching the lower threshold magnitude 226.

It is expected that, after opening the valve 70 at point 227, that the temperature 200 will continued to decline briefly, to point 240, and then begin to increase until it eventually reaches the upper threshold magnitude 210 at point 246. Then, the microprocessor 74 again closes valve 70 to cause more cooling water to flow through the monitored heat emitting components. By observing changes, over time, of the magnitudes of the elapsed times such as that represented by arrow 230, the efficiency of the pump 16 can be monitored. Through simple mathematics, a trend line can be determined which shows the gradual increase in length of the elapsed time 230. These mathematical techniques are well known to those skilled in the art and will not be described in detail herein.

A simpler approach, in an alternative embodiment of the present invention, is to simply store a maximum elapsed time figure against which the measured elapsed time 230 is compared after each operation of the valve 70. During calibration of the system, a maximum theoretical elapsed time can be determined, with an appropriate safety margin, which indicates that the blades of the flexible vanes of the pump 16 are sufficiently warned to justify replacement, but not sufficiently warned to risk significant damage to heat emitting components. Appropriate safety margins would typically be employed in determining this maximum elapsed time so that changes in ambient temperature and water temperature would not result in sufficient variation of the measured elapsed time 230 to cause an improper warning to be issued or, alternatively, to cause a worn vane of the pump 16 to be overlooked.

Figure 4:
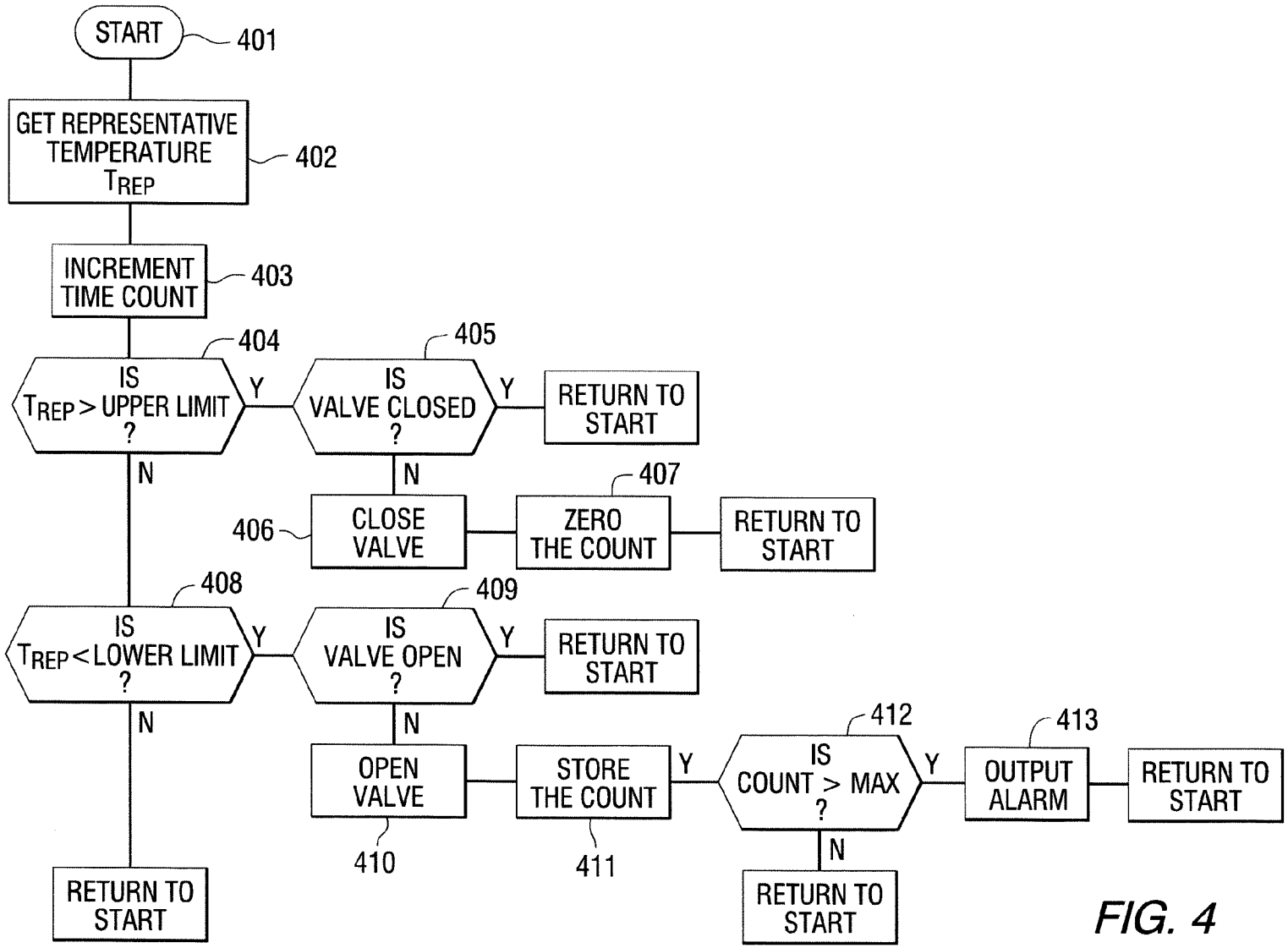
FIG. 4 is an exemplary simplified flowchart of a program used to assess the condition of flexible vanes in the pump of the cooling system.

FIG. 4 is an exemplary flow chart which shows the steps that would be taken by a basic form of a preferred embodiment of the present invention. Beginning at functional block 401, the microprocessor 74 would obtain a representative temperature from the sensors, 100 and 102, at functional block 402. It should be understood that this representative temperature could be an average that is mathematically derived from several temperatures or it could be the maximum of several measured temperatures. The particular technique used to determine a representative temperature from a plurality of sensed temperatures is not limiting to the present invention. At functional block 403, a stored count is incremented. A functional block 404, the representative temperature is compared to the upper threshold magnitude 210 described above in conjunction with FIG. 3. If the representative temperature is higher than the upper threshold magnitude 210, as represented at point 211, the microprocessor 74 checks to see if the valve 70 is closed at functional block 405. If it is already closed, the program returns to the start position 401. If the valve is not closed, this means that this is the initial time that the representative temperature was detected above the upper threshold magnitude 210. Therefore, the valve is closed at functional block 406 and the count is zeroed at functional block 407 so that an elapsed time can be measured subsequent to the closing of the valve 70. Then the program returns to the start position.

If the answer to the question at functional block 404 is negative, that means its representative temperature is below or, at most equal to, the upper threshold magnitude 210. It then checks whether or not it is lower than the lower threshold magnitude 226 at functional block 408. If it is, such as represented by points 227 and 240 in FIG. 3, the program checks to see if the valve 70 is open at functional block 409. If it is open, the program returns to start. If it is not open, that means that the temperature has initially crossed the lower threshold magnitude 226, such as at point 227 in FIG. 3. Then, the valve is opened at functional block 410, the count is stored at functional block 411, and the count is compared to a maximum at functional 412. This step at functional 412 compares the measured elapsed time 230 to an allowed maximum elapsed time that would indicate the need to replace the vanes of the pump 16. If the count exceeds the maximum, an alarm is provided at functional block 413 and the program returns to start. If not, no alarm is provided and the program returns to start.

The simplified flowchart shown in FIG. 4 provides basic information relating to the need for replacing or repairing the pump 16. Naturally, more complex mathematical analysis can be performed on the information obtained from the count. As an example, sequential counts can be stored for some historic number of valve closings. For example, the previous 200 valve closings can be stored to determine a trend. In addition, the standard deviation and variants of the stored data can be used to determine the variability of the prior measurements of elapsed time that may indicate the need for maintenance. It should be clearly understood that the specific analysis performed on the data provided by a process such as that represented in FIG. 4 is not limiting to the present invention.

Although the present invention has been described with particular specificity and illustrated to show a specific configuration of components and a particular method for controlling the valve and monitoring the pump condition, it should be understood that alternative embodiments are also within its scope.

We claim:

1. A cooling system for a marine propulsion device, comprising:

a cooling passage disposed in thermal communication with a heat emitting component;

a pump having an outlet port connected in fluid communication with an outlet conduit and an inlet port connected in fluid communication with an inlet conduit, said inlet conduit being configured to conduct water to said pump from a body of water in which said marine propulsion device is operated, said outlet conduit being connected in fluid communication with said cooling passage;

a bypass conduit connected in fluid communication between said outlet conduit and said inlet conduit;

an exhaust conduit connected in fluid communication with said outlet conduit, said bypass conduit being connected to said outlet conduit between said pump and said exhaust conduit;

a valve connected in fluid communication with said bypass conduit and configured to affect the rate of flow of water from said outlet conduit to said inlet conduit; and a controller connected in signal communication with said valve and configured to control said valve as a function of a sensed operating parameter of said marine propulsion device.

2. The cooling system of claim 1, further comprising:

a fuel cooler connected in fluid communication with said outlet conduit between said pump and said valve.

3. The cooling system of claim 1, further comprising:

a steering fluid cooler connected in fluid communication with said outlet conduit between said pump and said valve.

4. The cooling system of claim 1, further comprising:

an oil cooler connected in fluid communication with said outlet conduit, said bypass conduit being connected to said outlet conduit between said pump and said oil cooler.

5. The cooling system of claim 1, further comprising:

a temperature sensor connected in signal communication with said controller and disposed in thermal communication with said exhaust conduit, said sensed operating parameter of said marine propulsion device being a sensed temperature of said exhaust conduit.

6. The cooling system of claim 1, wherein:

said heat emitting component is a heat exchanger.

7. The cooling system of claim 6, further comprising:

an engine having a cooling channel configured to conduct a coolant in thermal communication with heat producing portions of said engine, and in thermal communication with a water channel of said heat exchanger, said water channel of said heat exchanger being disposed in fluid communication with said outlet conduit.

8. The cooling system of claim 7, further comprising:

a temperature sensor connected in signal communication with said controller and disposed in thermal communication with said coolant, said sensed operating parameter of said marine propulsion device being a sensed temperature of said coolant.

9. A cooling system for a marine propulsion device, comprising:

a cooling passage disposed in thermal communication with a coolant channel of a heat exchanger;

a pump having an outlet port connected in fluid communication with an outlet conduit and an inlet port connected in fluid communication with an inlet conduit, said inlet conduit being configured to conduct water to said pump from a body of water in which said marine propulsion device is operated, said outlet conduit being connected in fluid communication with said cooling passage;

a bypass conduit connected in fluid communication between said outlet conduit and said inlet conduit;

a valve connected in fluid communication with said bypass conduit and configured to affect the rate of flow of water from said outlet conduit to said inlet conduit;

a fuel cooler connected in fluid communication with said outlet conduit between said pump and said valve;

a steering fluid cooler connected in fluid communication with said outlet conduit between said pump and said valve; and a controller connected in signal communication with said valve and configured to control said valve as a function of a sensed operating parameter of said marine propulsion device.

10. The cooling system of claim 9, further comprising:

an oil cooler connected in fluid communication with said outlet conduit, said bypass conduit being connected to said outlet conduit between said pump and said oil cooler.

11. The cooling system of claim 10, further comprising:

an exhaust conduit connected in fluid communication with said outlet conduit, said bypass conduit being connected to said outlet conduit between said pump and said exhaust conduit.

12. The cooling system of claim 11, further comprising:

a first temperature sensor connected in signal communication with said controller and disposed in thermal communication with said exhaust conduit, said sensed operating parameter of said marine propulsion device being a function of a sensed temperature of said exhaust conduit.

13. The cooling system of claim 12, further comprising:

an engine having a cooling jacket configured to conduct a coolant in thermal communication with heat producing portions of said engine, said cooling jacket being connected in fluid communication with said coolant channel of said heat exchanger and in thermal communication with a water channel of said heat exchanger, said water channel of said heat exchanger being disposed in fluid communication with said outlet conduit.

14. The cooling system of claim 13, further comprising:

a second temperature sensor connected in signal communication with said controller and disposed in thermal communication with said coolant, said sensed operating parameter of said marine propulsion device being a function of a sensed temperature of said coolant.

15. A cooling system for a marine propulsion device, comprising:

a cooling passage disposed in thermal communication with a coolant channel of a heat exchanger;

a pump having an outlet port connected in fluid communication with an outlet conduit and an inlet port connected in fluid communication with an inlet conduit, said inlet conduit being configured to conduct water to said pump from a body of water in which said marine propulsion device is operated, said outlet conduit being connected in fluid communication with said cooling passage;

a bypass conduit connected in fluid communication between said outlet conduit and said inlet conduit;

a valve connected in fluid communication with said bypass conduit and configured to affect the rate of flow of water from said outlet conduit to said inlet conduit;

a controller connected in signal communication with said valve and configured to control said valve as a function of a sensed operating parameter of said marine propulsion device;

a fuel cooler connected in fluid communication with said outlet conduit between said pump and said valve;

a steering fluid cooler connected in fluid communication with said outlet conduit between said pump and said valve;

an oil cooler connected in fluid communication with said outlet conduit, said bypass conduit being connected to said outlet conduit between said pump and said oil cooler;

an exhaust conduit connected in fluid communication with said outlet conduit, said bypass conduit being connected to said outlet conduit between said pump and said exhaust conduit.

16. The cooling system of claim 15, further comprising:

an engine having a cooling jacket configured to conduct a coolant in thermal communication with heat producing portions of said engine, said cooling jacket being connected in fluid communication with said coolant channel of said heat exchanger and in thermal communication with a water channel of said heat exchanger, said water channel of said heat exchanger being disposed in fluid communication with said outlet conduit.

17. The cooling system of claim 16, further comprising:

a first temperature sensor connected in signal communication with said controller and disposed in thermal communication with said exhaust conduit, said sensed operating parameter of said marine propulsion device being a function of a sensed temperature of said exhaust conduit; and a second temperature sensor connected in signal communication with said controller and disposed in thermal communication with said coolant, said sensed operating parameter of said marine propulsion device being a function of a sensed temperature of said coolant.

* * * * *